US011662170B2

(12) United States Patent
Tasyagan

(10) Patent No.: US 11,662,170 B2
(45) Date of Patent: May 30, 2023

(54) SEMI-AUTOMATIC AND FULL AUTOMATIC WORKING SYSTEM AT PCP AIR RIFLES

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 67 days.

(21) Appl. No.: 17/046,784

(22) PCT Filed: Oct. 22, 2019

(86) PCT No.: PCT/TR2019/050885
§ 371 (c)(1),
(2) Date: Oct. 11, 2020

(87) PCT Pub. No.: WO2021/080522
PCT Pub. Date: Apr. 29, 2021

(65) Prior Publication Data
US 2022/0196358 A1 Jun. 23, 2022

(51) Int. Cl.
*F41A 19/33* (2006.01)

(52) U.S. Cl.
CPC ..... *F41A 19/33* (2013.01)

(58) Field of Classification Search
CPC ..... F41A 19/33; F41B 11/70
USPC ..... 89/140–142; 124/72
See application file for complete search history.

(56) References Cited

U.S. PATENT DOCUMENTS

| | | | | |
|---|---|---|---|---|
| 5,251,533 | A | 10/1993 | Layton | |
| 5,771,875 | A * | 6/1998 | Sullivan | F41B 11/54 124/72 |
| 7,836,872 | B2 * | 11/2010 | Tseng | F41A 19/33 124/39 |
| 9,068,792 | B2 * | 6/2015 | Macy | F41B 11/62 |
| 10,113,829 | B2 * | 10/2018 | Nachefski | F41A 19/10 |
| 10,288,373 | B1 | 5/2019 | Hardman et al. | |
| 2015/0345880 | A1 | 12/2015 | Macy | |
| 2018/0073831 | A1 | 3/2018 | Zhu | |
| 2020/0232749 | A1 | 7/2020 | Call | |

OTHER PUBLICATIONS

International Search Report of PCT/TR2019/050885, dated Jul. 22, 2020.
Written Opinion by TurkPatent—dated Jun. 10, 2022. Machine language translation provided.

* cited by examiner

*Primary Examiner* — Bret Hayes
(74) *Attorney, Agent, or Firm* — Phil IP Law Inc.; Narek Zohrabyan; Karen 'Kirk' Galoyan

(57) ABSTRACT

Invention relates to a system providing both semi-automatic and full-automatic feature to PCP (pre-charged pneumatic) air rifles. While 5 semi automatic or full automatic feature is provided in PCP (pre-charged pneumatic) air rifles separately, PCP air rifle mentioned in working principle developed by us have both semi automatic and full automatic operation capability.

6 Claims, 8 Drawing Sheets

SEMI-AUTOMATIC AND FULL AUTOMATIC WORKING SYSTEM AT PCP AIR RIFLES

TECHNICAL FIELD

Invention relates to a system providing both semi-automatic and fully-automatic feature to PCP (pre-charged pneumatic) air rifles. While semi automatic or fully automatic feature is provided in PCP (pre-charged pneumatic) air rifles separately, PCP air rifle mentioned in working principle developed by us have both semi automatic and fully automatic operation capability.

BACKGROUND OF THE INVENTION

PCP air rifles are operated by means of an integrated air tube system mounted thereon and cocking catch. Air pressure of certain amounts contained in the tube produced in different volumes activates the mechanism. Thus, PCP air rifle can make effective firing up to 500 meters subject to pressure and tube volume.

Said PCP air rifles have semi or fully automatic operating principle. Semi-automatic rifles can make one firing per each triggering without need for setting after initial setting. With fully automatic rifles, firing can continue up to magazine capacity as long as the trigger is pulled without need to set again after initial setting. On the other hand, vibration occurring with rifles working fully automatically may negatively affect the magazine.

For rifles working on semi automatic working principle, firing can not be made as long as trigger remains pulled whereas for fully automatic rifles trigger must be released serially in order to stop firing after pulled in order to make one firing.

Purpose of the Invention

PCP air rifles having semi automatic and fully automatic working principle are provided with both semi automatic and fully automatic working by means of one single mechanism.

When user puts level lever in semi-automatic position by means of mechanical system provided, one single firing is made per one single trigger pulling upon one single setting for magazine. When user puts level lever in fully automatic position, firing continues as long as trigger is pulled upon one single setting. Thus, PCP air rifle is equipped with both semi automatic and fully automatic use feature.

On the other hand, a support part is added to fix the magazine in order to protect magazine against vibration occurring particularly during fully automatic firing.

Detailed Description of the Invention

REFERENCE NUMBERS

Figure 1:
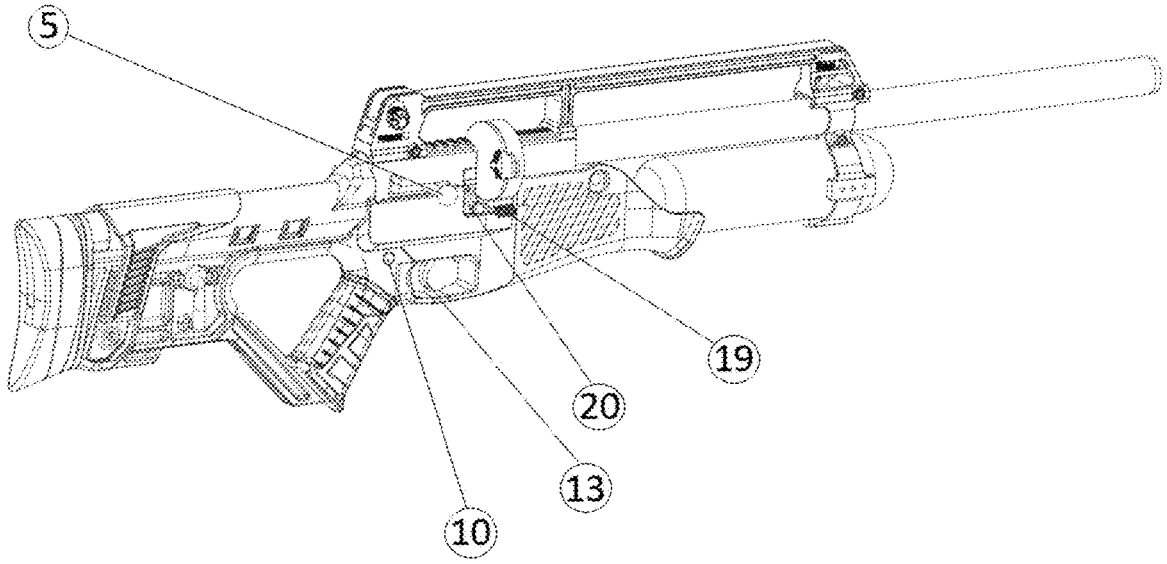
FIG. 1 General View of Rifle
FIG. 2 View of Invention on Rifle
FIG. 3 Zoomed in View of Invention on Rifle
FIG. 4 Exploded View of Invention Parts
FIG. 4A—Zoomed in view of level ball and level spring
FIG. 5 View of Position Ready for Fire in Semi Automatic Position
FIG. 6 View of Trigger Tab Pulling Hold Position for Next Firing for Fired Semi Automatic Rifle
FIG. 7 View of Fully Automatic Tab Pulling Hold Position where Trigger Pulled Lever Back for Fully Automatic Position Rifle FIG. 8 View of Position where in Fully Automatic Position Trigger Pulled in Lever Fully Automatic Tab Opened when Cock Motion Completed
FIG. 9 View of Cock and Cock Lever
FIG. 10 View of Trigger Tab Stopper
FIG. 11 View of Level Lever
FIG. 12 View of Fully Automatic Tab
FIG. 13 View of Lever
FIG. 14 View of Magazine Support Part Body
FIG. 15 View of Magazine Support Part
Figure 2:
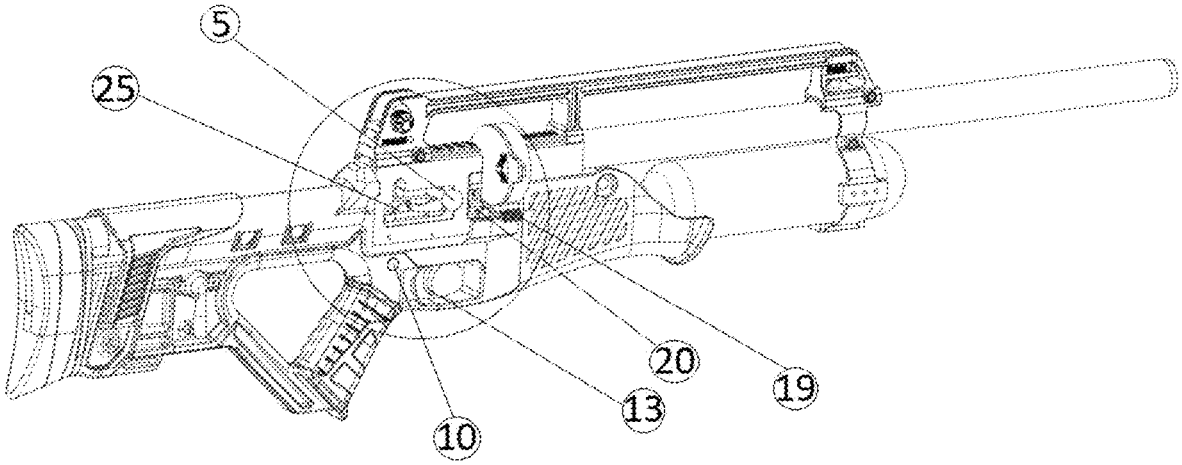
Figure 3:
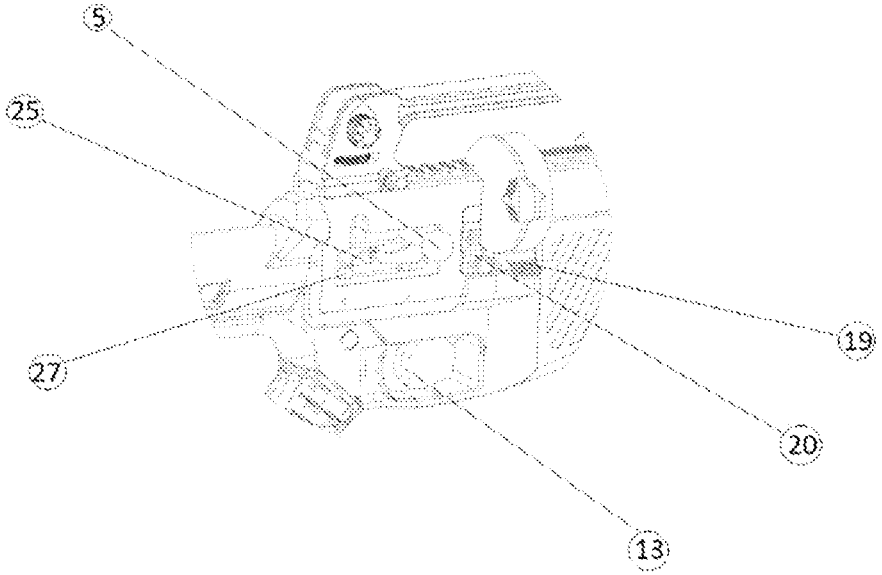
Figure 4:
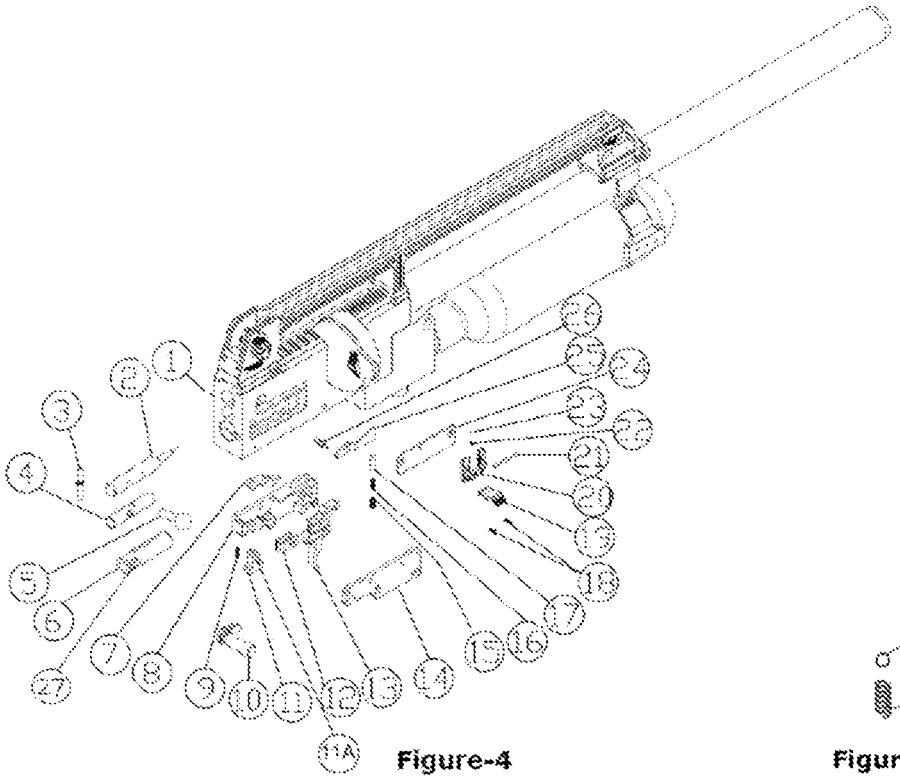
Figure 4A:
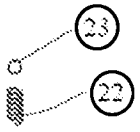

1. Mechanism
2. Pellet Pusher
3. Pellet Pusher Pin
4. Lever Wedge
5. Lever
6. Cock
7. Trigger Tab
7A. Connection housing
8. Trigger Case
9. Stopper Spring
10. Level Lever
11. Trigger Tab Stopper
11A. Connection housing
12. Semi Automatic Trigger Sheet
13. Trigger
14. Trigger Case Cover
15. Fully Automatic Tab Spring Cover
16. Fully Automatic Tab Pusher Spring
17. Fully Automatic Tab Pusher Shell
18. Support Screw
19. Magazine Support Tab
20. Magazine Support$_{[KG1]}$
20A. Level spring housing
21. Support Pin
22. Level Spring
23. Level Ball
24. Fully Automatic Tab Housing Cover
25. Fully Automatic Tab
26. Fully Automatic Tab Pusher Pin
27. Wedge
28. Projecting end
29. Tail This is an invention made to equip PCP air rifles with capability to operate fully automatically with the development made in our rifles having semi automatic working principle. One of the main components of the invention is the level lever (10) pressed by user to activate shifting from semi automatic to fully automatic system or from fully automatic system to semi automatic system for PCP air rifles. Mechanical operation structure changes with level lever (10) and thus PCP air rifle gains feature of both semi automatic and fully automatic operation feature.

Figure 5:
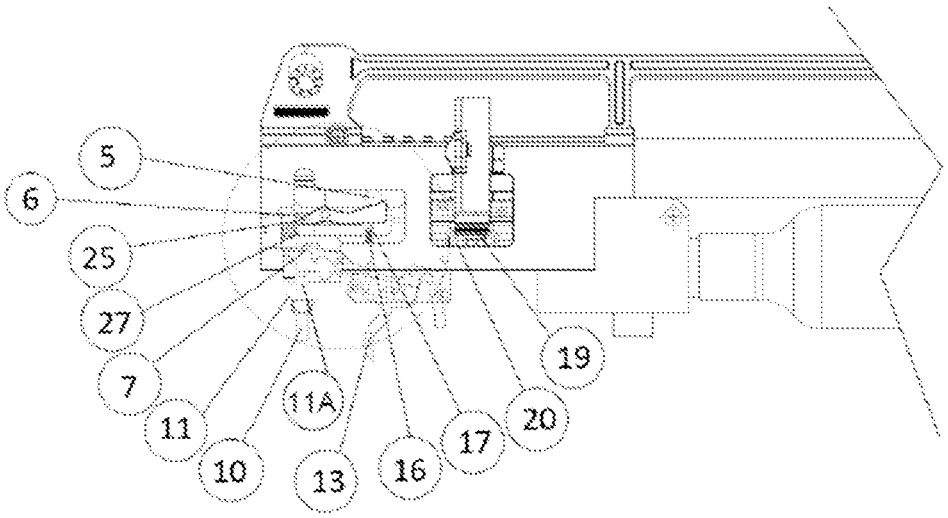
Figure 6:
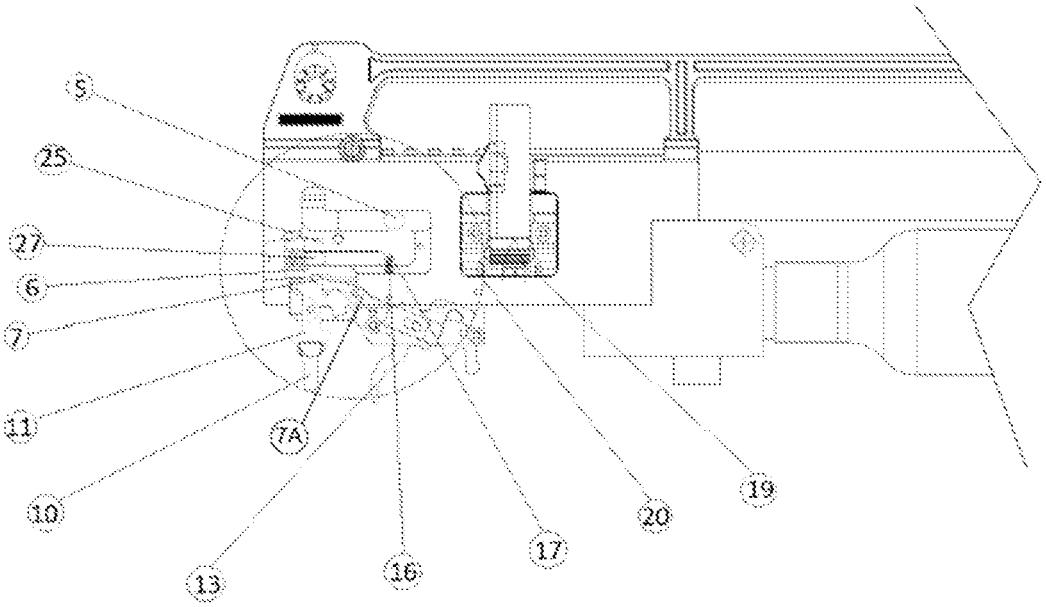
Figure 7:
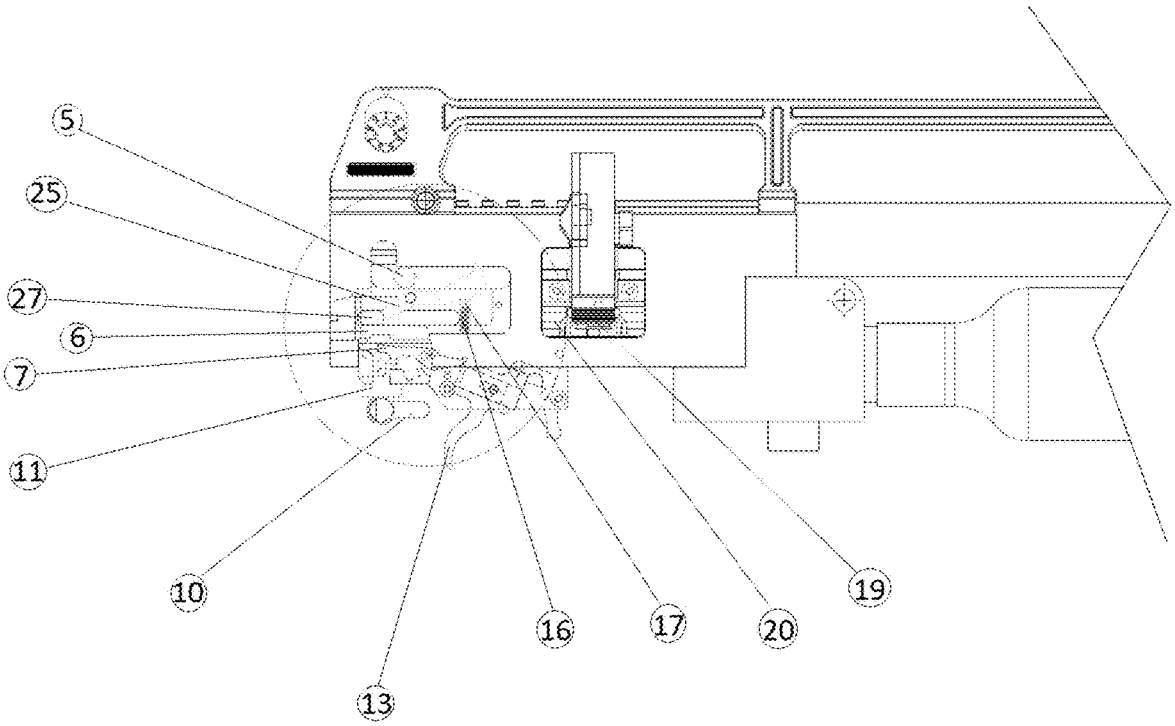
Figure 8:
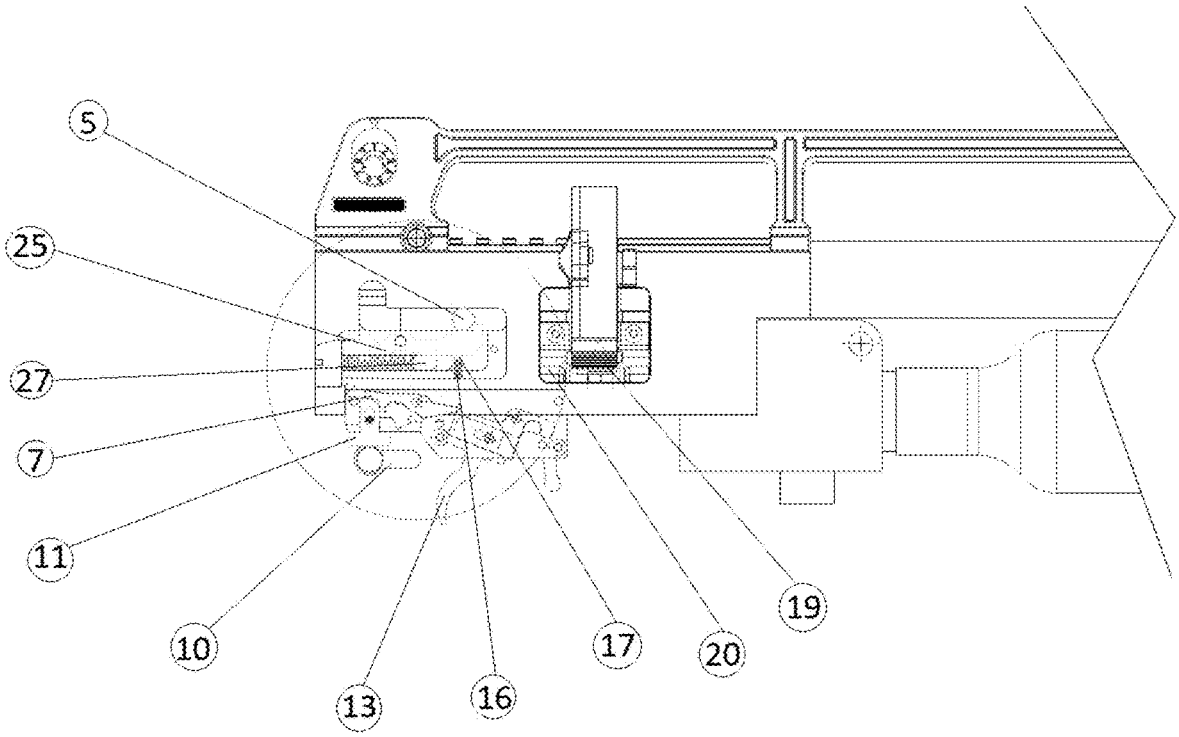
Figure 9:
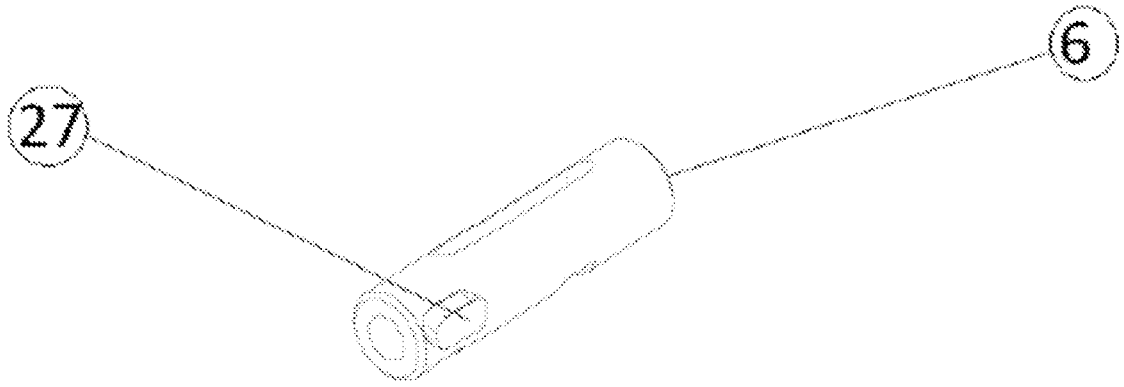
Figure 10:
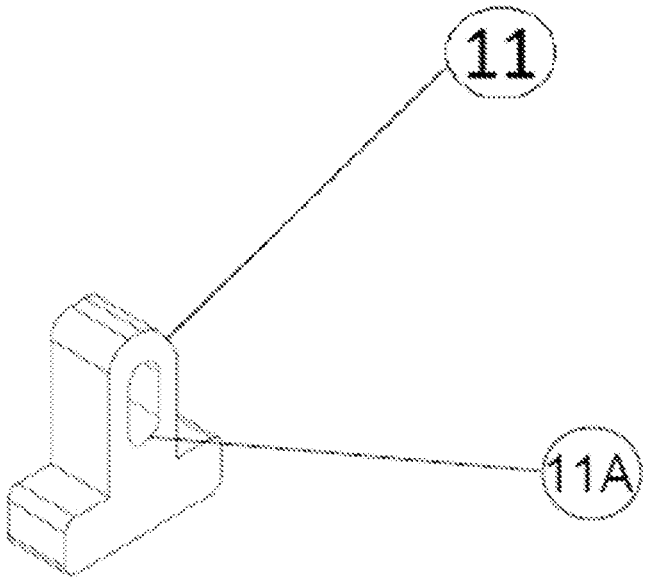
Figure 11:
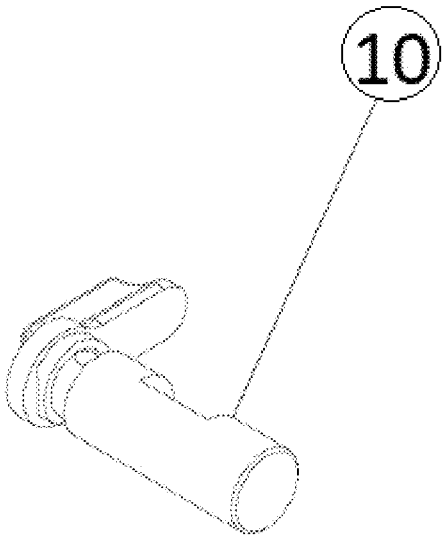

When the level lever (10) shown in FIG. 11 is in semi automatic position (FIG. 5), trigger tab stopper (11) part in upside down T form does not make any attempt to stop trigger tab (7) thanks to stopper spring (9). When rifle is fired, cock (6) goes forward and then comes back and trigger tab (7) moves back and goes in front of semi automatic sheet (12), cock (6) is locked into trigger tab (7) again. Cock (6) is inserted into trigger tab (7) and motion forward is prevented and re-firing can not be made. When trigger (13) is released, semi automatic trigger sheet (12) goes above trigger tab (7) and becomes ready for firing. The motions are repeated and thus semi automatic operation is provided.

When level lever (10) is put in fully automatic position, trigger tab stopper (11) part moves upward by means of the connection housing (11A) which has vertical rectangular form rounded on short edges. Thus trigger tab stopper (11) moves ahead of trigger tab (7). Whenever trigger (13) is pressed, cock (6) is released from trigger tab (7) and initiates firing. Thus trigger tab (7) leans on trigger tab stopper (11) part and is not released from semi automatic trigger sheet (12) and does not go into position to hold trigger cock (6). The cock (6) repeats firing motion.

Figure 12:
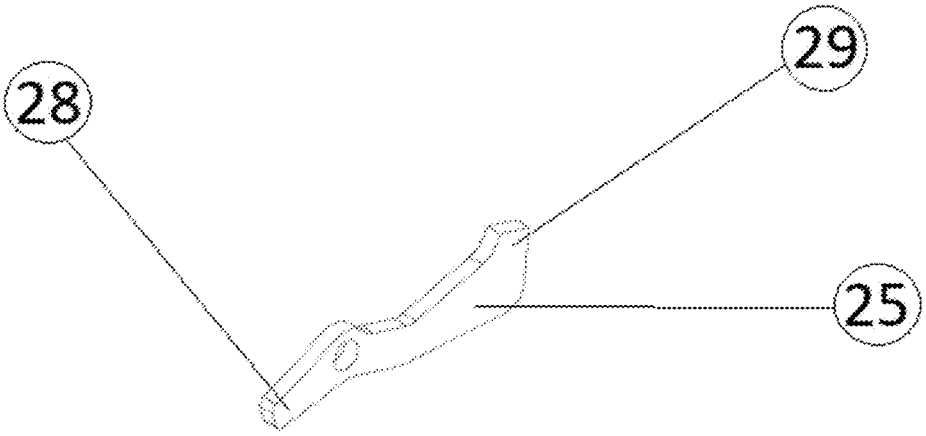
Figure 13:
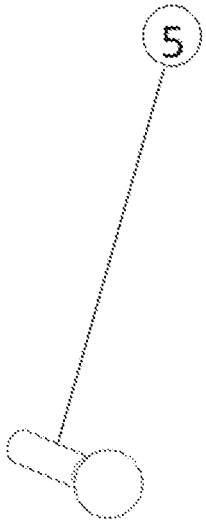
Figure 14:
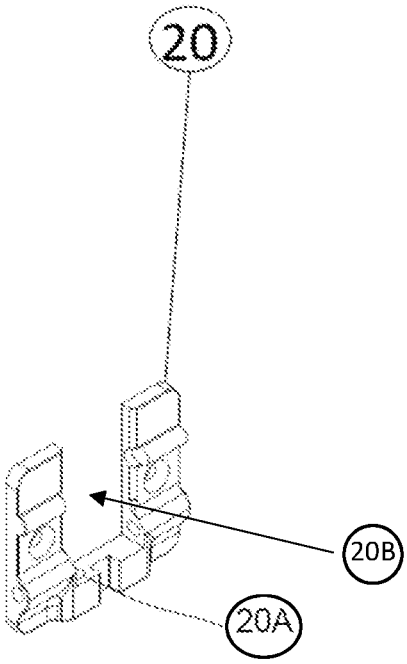
Figure 15:
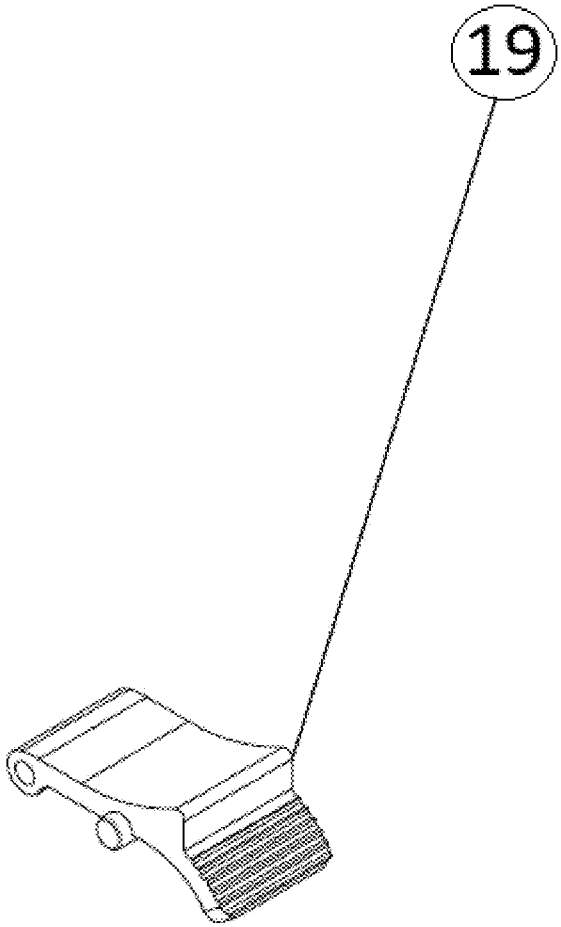

For fully automatic firing, the cock (6) is to run in harmony with sheet pusher (2) combining pellet pusher pin (3) and lever wedge (4). Unless pellet pusher (2) motion is completed, next firing should not be made by the cock (6). In order to solve this issue, the mechanism (1) is added fully automatic tab (25) in form of plane without wings, which is shown in FIG. 12.

When the cock (6) returns, fully automatic tab pusher shell (17) and fully automatic tab pusher spring (16) having fully automatic tab spring cover (15) goes upward from fully automatic tab (25) tail (29) part. Thus fully automatic tab (25) allowed to move by fully automatic tab pusher pin (26) passing through hole in fully automatic tab (25) body leaves the balance position and goes in front of wedge (27) located on projecting end (28) of fully automatic tab (25) and thus holds the cock (6). Meanwhile, lever (5) connected onto lever wedge (4) goes back and takes front position and moves fully automatic tab (25) downward from tail (29) and provides release of cock (6) wedge (27) from projecting end (28) of fully automatic tab (25) and re-firing. This cycle continues synchronously until trigger (13) is re-released.

When cock (6) returns, the wedge (27) located on the cock (6) leans onto fully automatic tab (25) projecting end (28) and holds the cock (6) by means of the wedge (27) and prevents front motion of the cock (6). Then the lever (5) connected to pellet pusher (2) by means of lever wedge (4) comes back and moves forward and moves fully automatic tab (25) downward from the tail (29) and releases the cock (6). This mechanic operation continues until trigger (13) is released. Also during this operation, fully automatic tab (25) and the parts located around and fully automatic tab (25) are protected by fully automatic tab housing cover (24) and their removal is prevented. In addition, trigger case (8) containing trigger (13), semi automatic trigger sheet (12), trigger tab (7), trigger tab stopper (11) therein is protected by means of closing trigger case cover (14) In order to protect magazine against vibration occurring during firing, magazine support (20) is connected to magazine and lower part of magazine by support screw (18) as shown in FIG. 1. Magazine support tab (19) is connected to lower part of magazine support (20) in U shape by means of support pin (21). The magazine support tab (19) is pivotally connected to a lower part of the U shaped opening (20B) of the magazine support (20).

While motion is provided by help of level spring (22), level feature is provided by means of level ball (23). While magazine housing is empty, magazine support tab (19) is protected thanks to foldable towards magazine housing as a result of such motion.

What is claimed is:

1. A semi automatic and fully automatic operation system, comprising:

a trigger;

a level lever having two operative positions, a semi automatic position and a fully automatic position;

a trigger tab stopper positioned on top of the level lever, wherein the level lever, in the fully automatic position, pushes the trigger tab stopper upwards;

a cock positioned above the trigger tab stopper and the trigger, wherein a wedge protrudes from the side of the cock;

a trigger tab positioned in between the trigger tab stopper and the trigger and below the cock;

the trigger tab engages with the cock when the level lever is in the semi automatic position;

the trigger tab is prevented from engaging with the cock when the level lever is in the fully automatic position;

a lever wedge positioned above the cock, wherein a lever protrudes from the side of the lever wedge;

a pellet pusher positioned above the lever wedge, wherein the pellet pusher is connected to the lever wedge through a pellet pusher pin;

a fully automatic tab is positioned in between the lever and the wedge;

the fully automatic tab has a projecting end and a tail; and a fully automatic tab pusher shell, a fully automatic tab pusher spring, and a fully automatic tab spring cover positioned under the tail of the fully automatic tab, wherein the fully automatic tab pusher spring pushes the fully automatic tab upward by pressing the tail from its underside.

2. The semi automatic and fully automatic operation system of claim 1, wherein the trigger tab stopper has a connection housing vertically oriented within the trigger tab stopper and the connection housing has a rectangular shape wherein the four inside corners are rounded.

3. The semi automatic and fully automatic operation system of claim 1, wherein the trigger tab has a connection housing horizontally oriented within the trigger tab and the connection housing has a rectangular shape wherein the four inside corners are rounded.

4. The semi automatic and fully automatic operation system of claim 1, wherein the projecting end has a downward slope relative to the tail.

5. A device, comprising:

a U shaped magazine support;

a magazine support tab, pivotally connected to a lower part of an opening of the U shaped magazine support using a support pin;

a level spring located in a level spring housing; and a level ball positioned on top of the level spring.

6. The device of claim 5, wherein the level spring and the level ball are located in between the U shaped magazine support and the magazine support tab.

* * * * *